US006769377B2

(12) United States Patent
Rupp, II

(10) Patent No.: US 6,769,377 B2
(45) Date of Patent: Aug. 3, 2004

(54) GEAR DRIVEN OUTRIGGER POSITIONER

(76) Inventor: Herbert E. Rupp, II, 4761 SE. Anchor Ave., Stuart, FL (US) 34997

( * ) Notice: Subject to any disclaimer, the term of this patent is extended or adjusted under 35 U.S.C. 154(b) by 0 days.

(21) Appl. No.: 10/294,007

(22) Filed: Nov. 12, 2002

(65) Prior Publication Data

US 2004/0035350 A1 Feb. 26, 2004

Related U.S. Application Data

(60) Provisional application No. 60/404,732, filed on Aug. 20, 2002.

(51) Int. Cl.[7] ..... B63B 35/14

(52) U.S. Cl. ..... 114/255; 43/21.2; 248/514

(58) Field of Search ..... 114/255; 43/21.2, 43/27.4; 248/514, 515

(56) References Cited

U.S. PATENT DOCUMENTS 2,927,754 A * 3/1960 Davis ..... 248/514
3,060,614 A * 10/1962 Prince ..... 43/6.5
3,063,668 A * 11/1962 Yohe ..... 248/538
4,875,428 A * 10/1989 Schlesch et al. ..... 114/255
4,901,469 A * 2/1990 Murray ..... 43/21.2
4,993,346 A 2/1991 Rupp
5,140,928 A * 8/1992 Frick ..... 114/255
5,243,927 A * 9/1993 Messick ..... 114/255
5,245,780 A * 9/1993 Hansen et al. ..... 43/27.4
5,592,893 A * 1/1997 Jordan et al. ..... 114/255
5,738,035 A 4/1998 Ruppl
5,855,088 A * 1/1999 Lee ..... 43/21.2

* cited by examiner

*Primary Examiner*—Andrew Wright
(74) *Attorney, Agent, or Firm*—McHale and Slavin, P.A.

(57) ABSTRACT

A gear-train driven outrigger device for use on a fishing vessel having a first tubular member for holding of an outrigger pole, which is rotatably journaled to a second tubular member that is mounted to a fixed structure. The second tubular member housing a gear-train driver assembly that allows manual or motor driven rotation of the outrigger pole. The gear-train driver assembly constructed and arranged to provide infinite adjustment of the outrigger pole upon rotation of the first tubular member. The rotation of the first tubular member allows for movement of the outrigger pole from a stowage position to a trolling position and vice versa.

37 Claims, 9 Drawing Sheets

GEAR DRIVEN OUTRIGGER POSITIONER

RELATED U.S. APPLICATION

This application is a continuation-in-part of U.S. Provisional Patent Application No. 60/404,732 filed Aug. 20, 2002, the contents of which are incorporated herein by reference.

FIELD OF THE INVENTION

This invention relates to the field of fishing and more particularly to an improved outrigger positioner for use on fishing boats.

BACKGROUND OF THE INVENTION

While numerous methods of saltwater fishing exist, the use of a boat has many advantages for both the professional and recreational fisherman. For this reason, many boat manufacturers have built vessels directed solely to the art of fishing. Open fishing boats, so defined due to the open area around a center console, are of particular interest since they are capable of high speeds, are economical to operate, and provide a very safe platform from which to fish from.

While outriggers are a common fixture on large sport-fishing vessels, the use of the open fishing vessels have become a viable option to many anglers. Notwithstanding the obvious cost savings in vessel purchase, maintenance, and operating cost, the open fishing vessel can be made extremely fast and are highly maneuverable making them the preferred vessel for fishing tournaments and recreational fishing. Mounting of an outrigger system on an open fishing vessel is unlike that of a conventional sport fishing vessel since a benefit of the open fishing vessel is the ability to walk around a centrally located console station. Most open fishing vessels include the use of a T-top that, as the name implies, is formed from a "T" like structure to provide shade and rain protection for those standing around the console. The T-top does not inhibit operation of the vessel and allows an occupant to walk around the vessel uninhibited.

The Assignee of this present invention is the owner of U.S. Pat. Nos. 5,738,035 and 4,993,346, incorporated herein by reference, which teach the use of outriggers for use on open fishing vessels having a T-top, half tower, or the like. Current boating designs for high speed fishing vessels ideally allow the placement of outriggers in a stowage position, movable to a trolling position, without interfering with the occupant area. The use of a combination control lever and locking mechanism permits placement of the outrigger by manipulation of the control lever safely within the confines of the vessel.

Fishing with outriggers is performed when a fishing vessel is driven slowly, commonly referred to as trolling, which permits the strategic placement of bait behind the vessel. Trolling allows the fishing vessel to cover large areas of water so as to increase the chance of catching fish. The quantity and spacing of the bait placed behind the vessel is generally proportional to the size of the vessel, as well as the success of the fishing expedition. If the bait is properly placed, the wake generated by the vessel can be made to appear like a school of fish. Bait that appears to be struggling or separated are most attractive to predator fish.

The positioning of bait behind a vessel would be limited but for the use of the outriggers. Most open fishing vessels have a beam less than ten feet. Trolling with more than two fishing lines behind the vessel provides very little distance between the baits and limits the ability to place bait outside of the boat wake. Further, more than two lines behind a narrow beam vessel severely limits vessel maneuvering. Even a gradual turn may cause bait lines to cross and become entangled. In addition, closely positioned baits can become entangled during a fish strike.

The use of outriggers provides a means for effectively widening the spacing of the bait, as well as adding additional bait/lines without fear of tangling of the lines. An outrigger is basically a long pole having a proximal end coupled to the vessel and a distal end that can be rotated from a stowage position outboard to a trolling position. A positioning line is drawn along the length of the outrigger pole wherein release clips secured to the positioning line are used to secure the fishing pole line at a desired location. When a fish strikes the bait, the release clip disengages the fishing line from the positioning line, and the fisherman is free to reel in the fish without interference. Proper placement of the outrigger pole and fishing line increases the chances of fish being drawn to the bait.

For example, by use of two fifteen foot outriggers, a vessel with a ten foot beam may extend the distances between bait, effectively covering a thirty foot spread behind the vessel. However, having outrigger poles extend from each side of a vessel during non-fishing times has obvious drawbacks. For this reason, outriggers must be stowable to allow for normal traveling and docking. The outriggers are typically stored within the vertical plane of the vessel, the vertical plane defined by the side walls of the vessel. In operation, the outrigger is swung laterally outward to a deployed position for fishing purposes. Typically, each outrigger pole may be ten to thirty feet long, longer poles being cabletrussed to prevent excessive flexing.

Mounting outriggers to open fishing vessels presents numerous problems, mainly due to the stability of a narrow beam boat in open water, as well as the operational speeds that the open fishing vessels are capable of. A basic requirement is the safety of the vessel occupants, wherein an operator of the outrigger can be rotated while the occupant remains in the safety of the vessel, preferably while standing next to the console, beneath the T-top. Associated with this safety aspect is the need for a locking mechanism capable of withstanding the large cantilever forces presented by the outrigger arrangement. For instance, a fifteen foot outrigger secured to a T-top has a distal end cantilevered from the base. When the vessel is placed in an ocean environment, it is not uncommon for the vessel to be subjected to large seas wherein the twisting force of the outrigger pole places an enormous strain on the base of the outrigger. If the outrigger's sole source of outrigger pole positioning is the locking mechanism, the locking mechanism must be able to withstand the entire force presented by the cantilevered configuration.

All known prior art outrigger systems employ a locking mechanism that, when the locking mechanism is in an unlocked position, allows the outrigger to freely rotate. Thus, a control situation occurs when an outrigger is unlocked while the vessel in being subjected to movement, such as wave displacement. In this situation the outrigger may move due to the rotational motion provided by the wave motion. Should the wave motion be violent, the rotational motion can be transferred to the outrigger resulting in a violent movement of the outrigger that the operator will not be able to control.

Rotational movements by wave action can create outrigger movement even if the locking mechanism is "engaged." This occurs if the locking mechanism is worn, fails, or simply is not capable of securing against the rotational forces caused by a cantilevered outrigger. Longer and/or heavier outriggers further the rotational associated problems exponentially. The result is a dangerous situation for vessel occupants located near or in the path of the outrigger. Should the locking mechanism fail in close quarter maneuvering, the outrigger might freely swing out resulting in damage to any item within the outrigger path. In addition, the conventional outrigger control for open fishing vessels provides a 1:1 ratio, therein the movement of a hand lever results in a corresponding movement of an outrigger. This straight ratio can make it difficult to operate long and/or heavy outrigger poles. Even if an outrigger pole is short, dirt and corrosion may inhibit pole movement.

Accordingly, what is lacking in the art is an outrigger positioner that provides controlled rotation of an outrigger pole by use of a constantly engaged rotation mechanism to prevent uncontrolled movement of the outrigger pole, as well as a means for increasing the torque applied through the outrigger positioning assembly.

SUMMARY OF THE INVENTION

A primary objective of the instant invention is to teach the use of a positive control outrigger pole utilizing a gear-train drive system that provides an increase in torque allowing rotation of the outrigger pole with minimal effort.

Another objective of the instant invention is to teach the use of a gear-train drive positioning system that provides infinite adjustment of an outrigger between a stowage position and a trolling position.

Yet another objective of the instant invention is to teach a multi-stage gear-train drive system that provides relatively slow rotation of an outrigger pole.

Still another objective of the instant invention is to teach the use of a secondary locking mechanism that operates as an assist only, not as a primary lock, thereby providing a second locking mechanism.

Still another objective of the instant invention is the provision of further improvements in the type of outrigger systems provided by the inventions disclosed in U.S. Pat. Nos. 4,993,346 and 5,738,035.

The objectives are accomplished in accordance with the invention by the provision of an improved outrigger positioning assembly that is installed on a T-top, half tower, full tower, or the like fishing vessel. Installation allows an outrigger pole to be supported by its bottom end portion above a T-top and permits a full range of rotational movement of the outrigger pole between the stowage position and the trolling position and vis versa. Rotation can be performed by a person safely standing in the fishing vessel in the shelter of the T-top by manipulation of a gear train assembly that provides positive engagement of the outrigger pole throughout the full range of positioning.

An essential component of the instant invention is the use of a gear-train to provide an increase in torque, allowing hand or small motor rotation to effect outrigger pole movement. The outrigger positioner of the instant invention employs a base member which is secured to a fixed structure, such as the T-top, having the gear-train driven positioner mounted beneath the T-top structure. Gear-trains are well known in the art and may include but should not be limited to: worm and wormgear, spur gears, helical gears, bevel gears, planetary gears, herringbone gears, ring and pinion gears, chain and sprockets, belts and pulleys and suitable combinations thereof. The gear-train driven assembly of the present invention preferably utilizes a worm and wormgear which effectuates a transfer of rotational torque from the hand crank or motor driven crank to cause a torque increased rotation movement of the outrigger pole. In this manner, positive movement of the outrigger pole from a stowage position over the fishing vessel to a trolling position is performed with fully engaged gears so that movement is controlled at all times. The use of the torque multiplier gear-train allows movement of oversized outriggers, even if the outrigger assembly has been poorly maintained resulting in friction inhibited movement.

In general, a first tubular member is rotatably journaled to a second tubular member which together form a base member. The second tubular member has a top end and a bottom end forming a longitudinal axis therebetween. The first tubular member rotator assembly includes a hand operated crank used for manual rotation of a driver gear located within a housing, the driver gear housing may be integrally formed or otherwise suitably coupled to the base member. The hand grip of the hand operated crank is positioned a fixed distance from the gear-train housing by a support post, the length of the support post can be made to accommodate the gear reduction ratio employed. The gear-train driver assembly can be locked into position by use of an engagement bracket which is pivotedly attached to the base member, and rotatable so that a tip of the engagement bracket is insertable into an aperture slot formed in the support post, to prevent rotation of the driver assembly. The engagement bracket is L-shaped wherein one wing of the engagement bracket is used as a lever while the second end wing of the engagement bracket is insertable into the slotted aperture of the support post. The outrigger assembly can be installed as original equipment or as a packaged kit for after market installation.

Other objectives and advantages of this invention will become apparent from the following description taken in conjunction with the accompanying drawings wherein set forth, by way of illustration and example, certain embodiments of this invention. The drawings constitute a part of this specification and include exemplary embodiments of the present invention and illustrate various objectives and features thereof.

DETAILED DESCRIPTION OF THE PREFERRED EMBODIMENT

Figure 1:
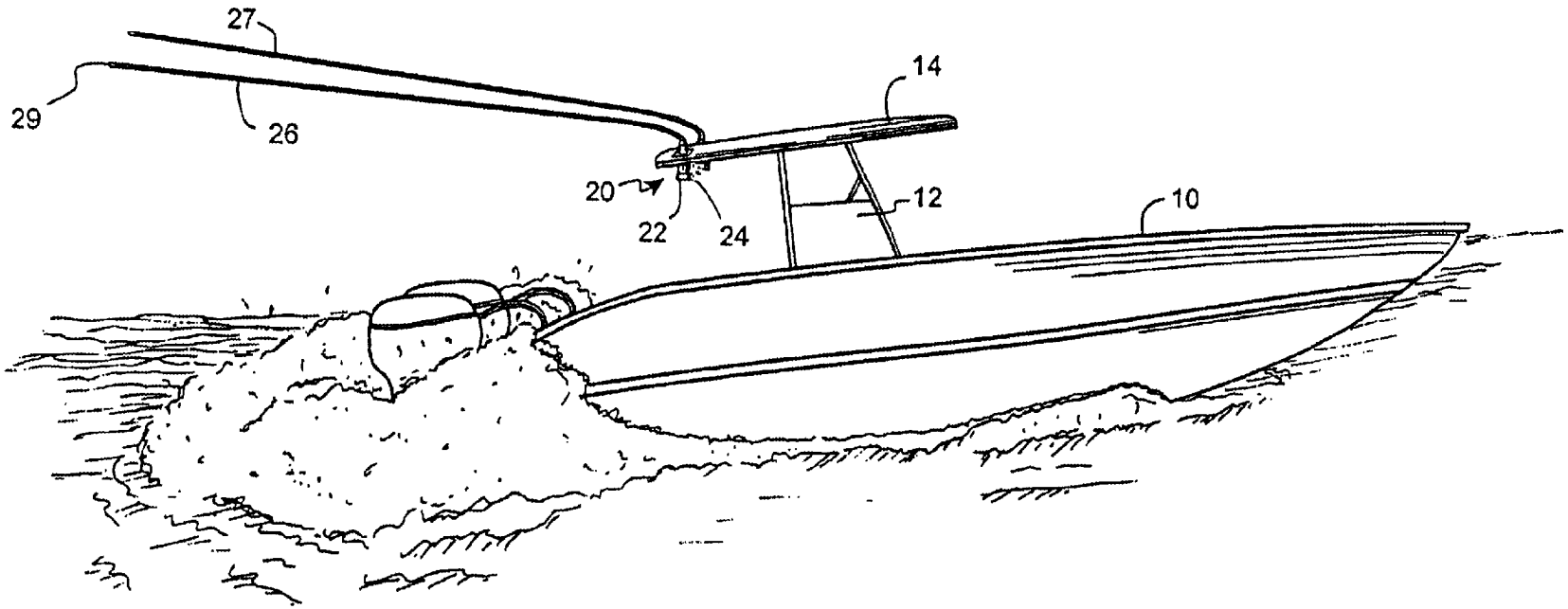
FIG. 1 is a pictorial illustrating the gear driven outrigger positioner of the instant invention.

Referring now to FIG. 1 set forth is a fishing vessel 10 having a centrally located console 12 with a T-top 14 extending over the console 12 providing an area of shade for the those occupants standing around the console. The rotatable outrigger assembly 20 of the instant invention includes a base member 22 securable to the T-top 14 having a gear-train driven positioner 24 mounted beneath the structure 14. Operation of the gear-train driven positioner 24 allows the outrigger 26 to have infinite rotational positioning in a horizontal plane relationship to the base member. In this manner the rotation positioner 24 provides positive movement of the distal end 29 of the outrigger pole 26 between a stowage position and a trolling position with fully engaged gears so that movement is controlled at all times.

A gear-train is generally defined as one or more pairs of gears operating together to transmit power. Gear-trains are well known in the art and may include but should not be limited to suitable combinations of: worm and wormgear, spur gears, helical gears, bevel gears, planetary gears, herringbone gears, ring and pinion gears, sprockets and chain, and belts and pulleys.

The rotation positioner assembly of the present invention preferably utilizes a worm and wormgear which effectuates a transfer of rotational torque from a hand crank or motor driven crank to cause a torque increased rotation movement of the outrigger pole 26. The use of single stage or multi stage torque multiplying gear-trains allow controlled movement of oversized outriggers, even if the outrigger assembly has been poorly maintained resulting in friction inhibited movement.

In the preferred embodiment, the rotation positioning means includes a manually rotatable crank, wherein the operator utilizes a hand grip to rotate a drive gear. Manual operation of the rotation positioner 24 can be complemented or replaced by a small electric or hydraulic motor. Electric motors and hydraulic motors generally run at relatively high speeds, significantly higher than those speeds required to effectively and accurately rotate an outrigger pole 26. Therefore, multiple stage gear-train reduction may be used within the rotational positioner 24 to accomplish slow rotation of the outrigger pole 26. This automatic type drive mechanism would employ a drive motor that is coupled to the shaft of the first drive gear. An operational switch can be located on the motor, situated next to the outrigger assembly, or remotely mounted on the dash of the boat console 12. The automatic drive mechanism is not illustrated as the use of a drive motor is of conventional design well known in the industry.

For ease of illustration, this specification will be directed to the use of a manual rotatable crank which is not limiting but rather for purposes of illustration. The key advantage of the instant invention is the use of a gear-train reduction assembly within the rotation positioner 24 that allows torque and rotational speed adjustment to impart the rotational action of the outrigger.

FIG. 1 further depicts outrigger No. 26 positioned in a right hand position and outrigger No. 27 positioned in a left handed position. As will be explained in more detail later in this disclosure, the rotatable outrigger assembly 20 allows an installer to choose the most advantageous position of the crank assembly for rotation on either the inside or outside locations of the T-top 14, with variations such as allowing the crank assembly handles to be both on one side, opposite sides, or the same side as operator preference dictates.

Figure 2:
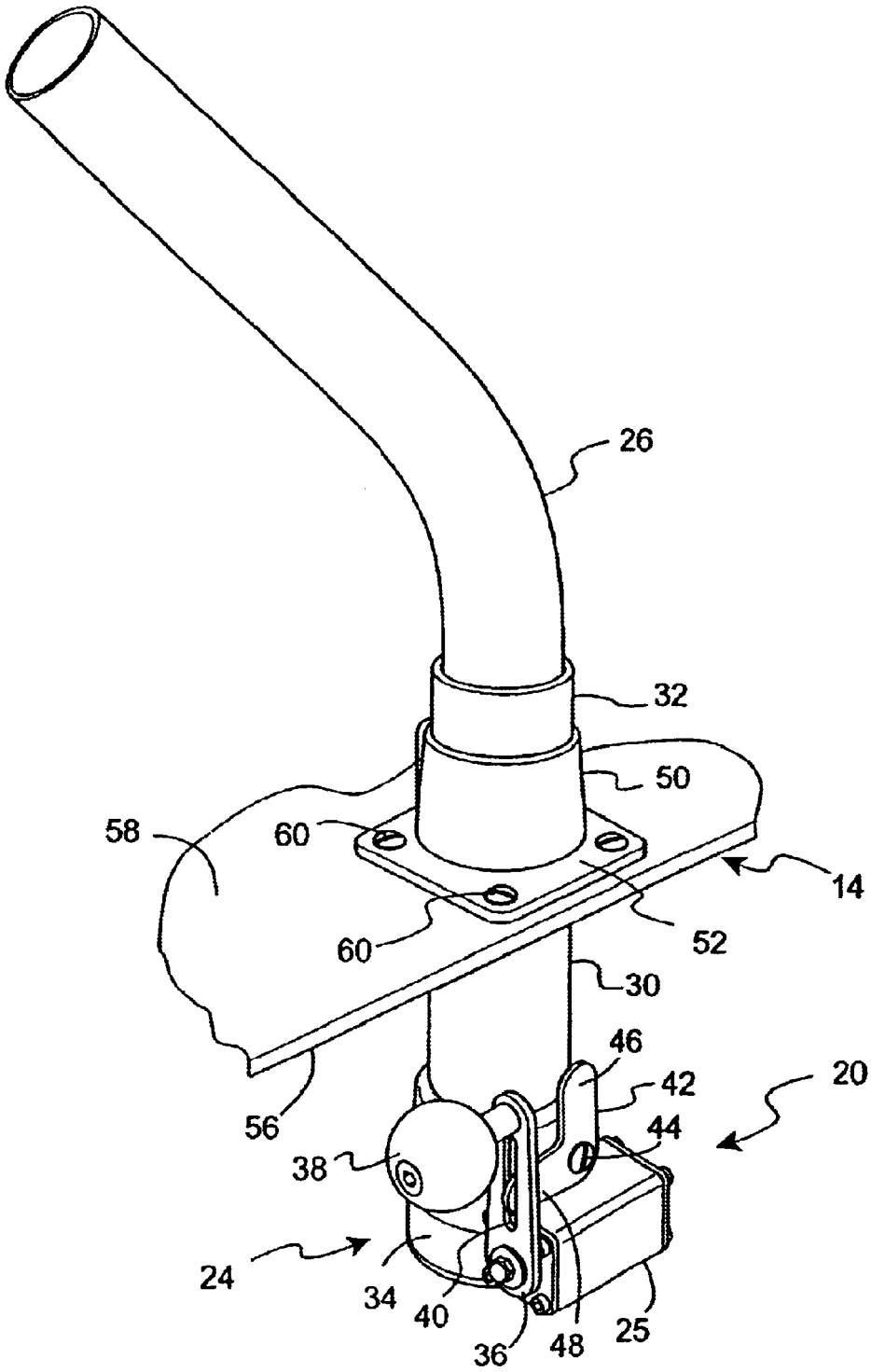
FIG. 2 is a plane side view of the gear driven outrigger positioner.
Figure 3:
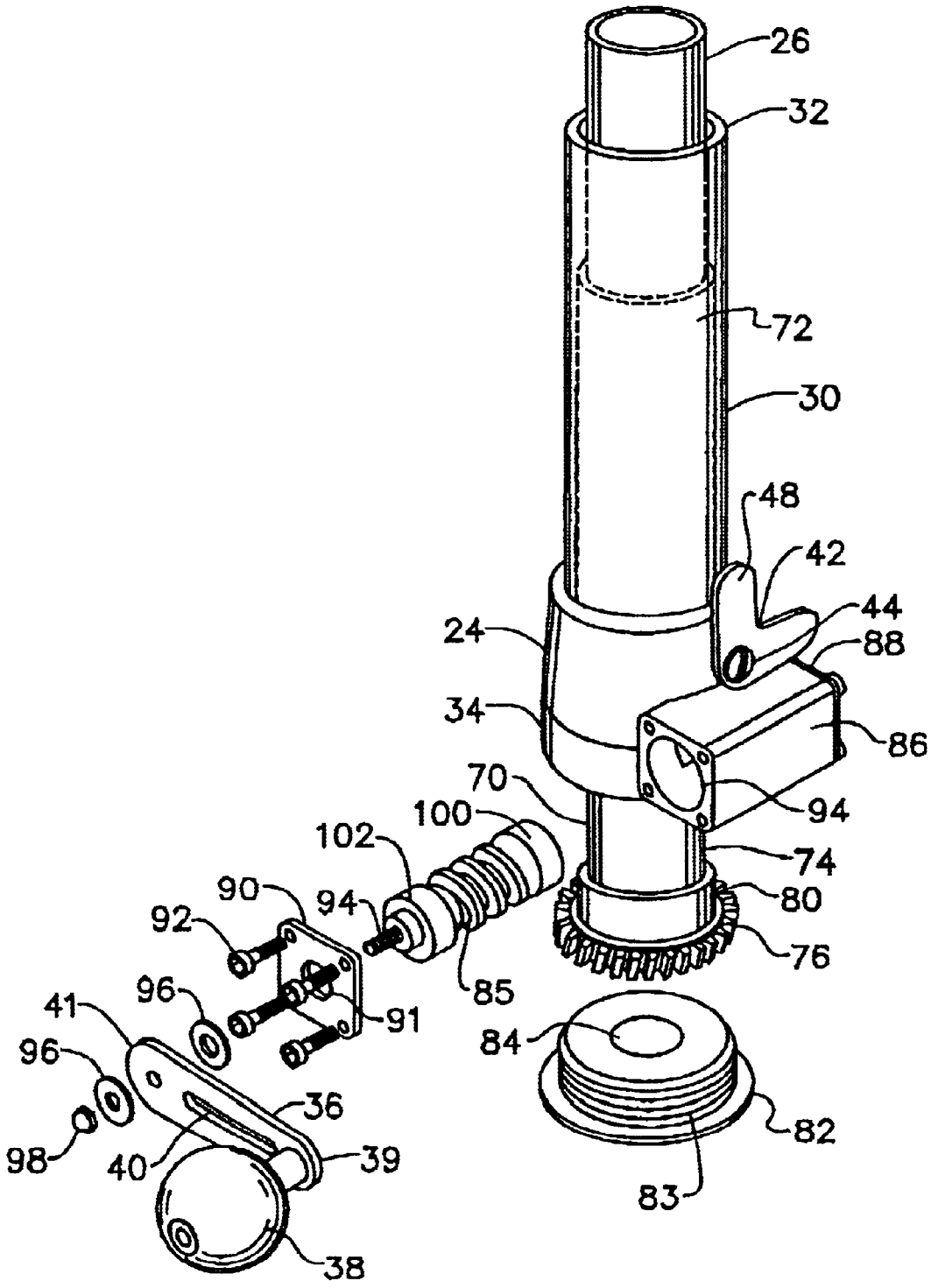
FIG. 3 is an exploded view thereof.
Figure 4:
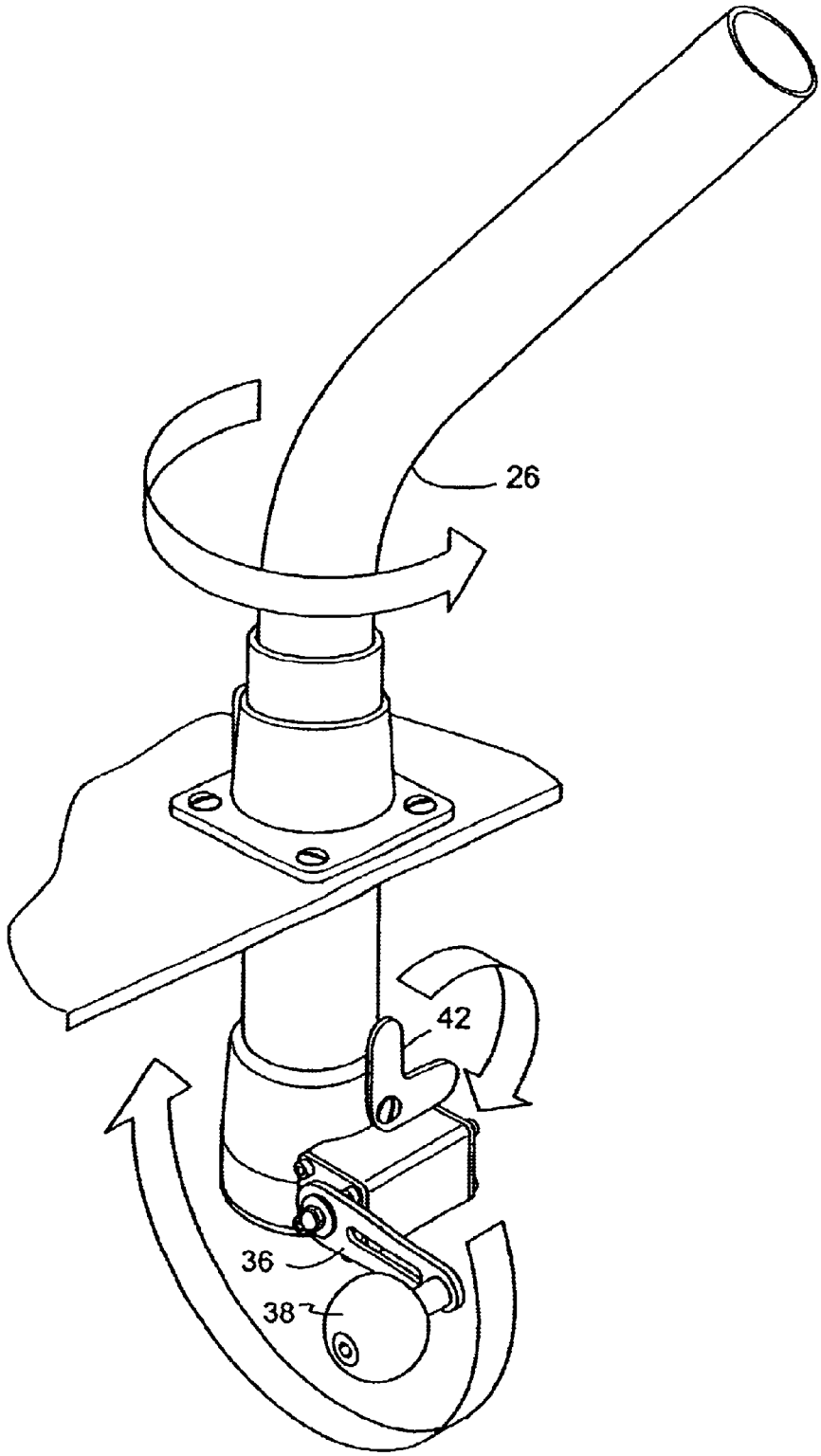
FIG. 4 is a plane side view providing illustrative directional arrows of rotation.

Referring now in general to FIGS. 2–4, depicted is the gear-train rotatable outrigger assembly 20 (FIG. 2) of the instant invention. A first tubular member 70 (FIG. 3) is rotatably journaled to a second tubular member 30 which forms the base member. The first tubular member 70 may be sized to extend the length of the second tubular member 30 or consist of a small weldment suitably sized to accept the proximal end of an outrigger pole 26. The second tubular member 30 is defined by a top end 32 and a bottom end 34 having a longitudinal axis therebetween. A gear-train driver assembly 24, includes a hand grip 38 that is used for manual rotation of the driver gear, the hand grip 38 being positioned a fixed distance from the gear housing 25 by use of a support post 36. The length of the support post 36 is sized to accommodate a gear-train ratio employed, described later in this application, with concern made for the support post 36 to consume as little space as possible so as not to interfere with the operation of the vessel or occupant space.

The gear-train driver assembly 24 can be locked into position by use of a slotted aperture 40 in the support post 36 which allows engagement bracket 42, pivotally attached along pivot point 44, to engage the slot and prevent rotation thereof. The engagement bracket 42 is L-shaped wherein one wing 46 of the engagement bracket 42 can be used as a lever while the second end wing 48 of the engagement bracket 42 is insertable into the slotted aperture 40 of the support post 36.

Mounting of the outrigger assembly to a fixed structure 14 such as a T-top, can be provided through a number of installations, all well known in the art. Common installations include welding the outrigger assembly 20 to a fixed structure, either in a parallel configuration or in-line. However, the preferred installation method is the use of a sleeve 50 and fastening bracket 52. In this type of installation, a hole is formed in the fixed structure, such as the T-top 14 illustrated, of a size to allow insertion of the top end 32 of the second tubular support member 30 whereby only a portion of the second tubular support member 30 extends above the top surface 58 of structure 14 with the base member and drive assembly 24 located beneath the bottom surface 56 of the structure 14. The sleeve 50 and fastening bracket 52 is attached to the second tubular member 30 by either weldment, engagement grooves, or by friction fit thereby maintaining the assembly in a fixed position. The fastening bracket 52 is secured to the structure with screw fasteners 60 or the like. Outrigger pole 26 may then be inserted through the first end 32 of the second tubular member 30 to engage the first tubular member 70.

FIG. 3 depicts an exploded view illustrating the second tubular member 30 having a top end 32 and bottom end 34. The first tubular member 70 has a first end 72 and a second end 74 with the driven gear 76 secured to the bottom end of the first tubular member by any suitable rigid attachment means including but not limited to; engagement pin, weldment, or forming of a gear integral to the first tubular member. In the preferred embodiment, the driven gear 76 is in the form of a wormgear being directly connected to the first tubular member 70. To prevent metal on metal contact and associated wear, a non-metallic bearing 80, such as DELRIN acetal is positional between the first tubular member 70 and the second tubular member 30. The bearing operates to maintain the central positioning of the outrigger pole but also limit wear of contact areas that are likely to be neglected or otherwise devoid of lubricant. The gear-train driver assembly housing 24 is sized to accommodate the use of at least one externally mounted gear. A threaded cap 82, also made of a non-metallic material such as DELRIN acetal, provides a vertical thrust bushing as well as operates as a cap. Interior threads within the base member housing engage the matching threads 83 on cap 82. Aperture 84 allows drainage of condensation, rain water, and ocean spray, to prevent fouling of the gear assembly.

The drive gear 85 is preferably of a worm type having conjugate surfaces to match the driven wormgear 76 providing a continuous and positive contact between the drive gear 85 and the driven gear 76. The drive gear 85 is placed within the gear driver assembly positioning housing 86 having a right hand thrust cap 88 and a left hand thrust cap 90 using suitable fastening bolts 92 to capture the drive gear 85 in the drive gear aperture 94 provided along the interior surface of the gear driver assembly housing 86.

Low maintenance DELRIN acetal bushing 100 and 102 are placed on either side of the worm drive gear 85 providing proper positioning and low friction engagement. The support post 36 having slotted aperture 40 is secured along a first end 39 to the hand grip 38 and along the second end 41 to the drive gear by any suitable means well known in the art. Fastening means are illustrated herein as a removable threaded stud 94 that may be threadedly attached to extend from either end of the drive gear shaft, wherein the support post is secured in place by washers 96 and a locking nut 98. Alternatively, a suitable flexible type coupling, not shown, but of a conventional type may be utilized to attach a hydraulic or electric motor to the drive gear shaft.

The outrigger assembly of the instant invention may be used for either a left hand or right hand mounting arrangement. The left handed position as shown has thrust cap 90 with the aperture 91 allowing attachment of the crank assembly support post 36 with treaded stud 94. Alternatively the threaded stud 94 and thrust cap 90 having the aperture 91 may be removed from the left hand position and installed in the right hand position, while thrust cap 88 is installed on the left hand position.

FIG. 4 depicts operation by vertically circular rotation of the hand grip 38 causing a horizontally circular rotation of the outrigger pole 26. This rotation can occur only upon release of engagement bracket 42 which operates as a locking member upon insertion into the slotted aperture formed into the support post 36. The use of gear-train allows for the transfer of power from the gear driver to the outrigger with a predicted ratio of velocities and torque transfer. It has been found that a ratio of about 30:1 accommodates most sport fishing situations, wherein a small hand crank can be use for rotation beneath the T-top. Multiple stage gear-trains may be used to achieve ratios of over 5000:1. The use of heavy outrigger poles may benefit from a higher torque ratio which will require more drive gear rotation but less rotational force. Reversing rotation of the crank assembly allows return of the outrigger into the original stowage position, again with minimal effort, despite rocking of the vessel or any other forces that may cause interference in normal rotation of an outrigger.

Figure 5:
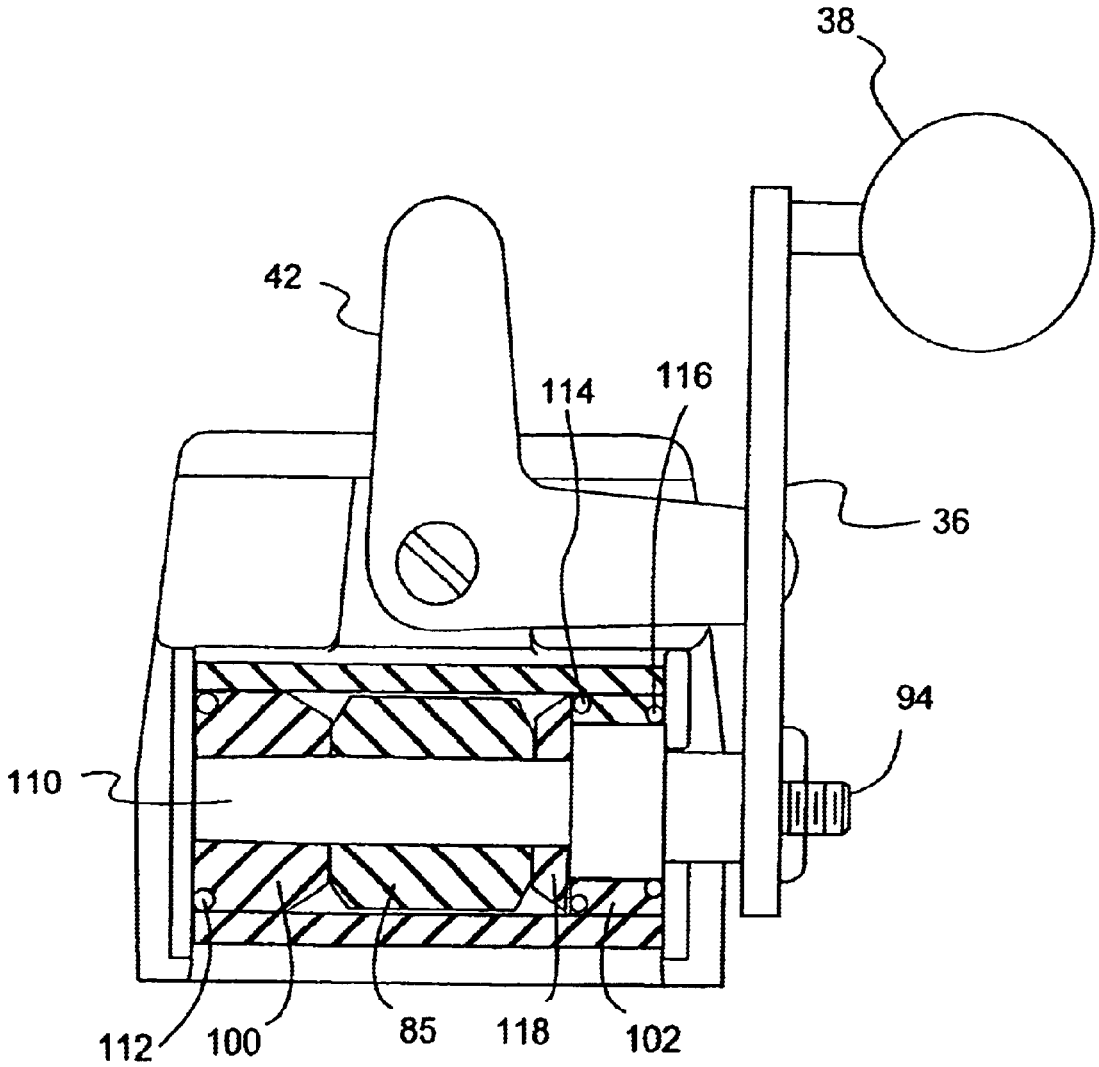
FIG. 5 is a cross sectional side view of the gearing assembly depicting right hand rotation.

FIG. 5 is a cross sectional side view of the gear driver assembly depicting the hand grip 38 on the right side of the assembly. The engagement lever 42 shown in engagement with support post 36 to prevent rotation of the drive gear 85. The drive gear 85 having a drive gear shaft 110 being supported on either side of the drive gear 85 by the non-metallic bushings 100 and 102. Seals 112, 114 and 116 inhibit water intrusion around bushings 100 and 102. A thrust washer 118 is used for reducing friction and maintaining proper engagement between the drive gear and driven gear.

Figure 6:
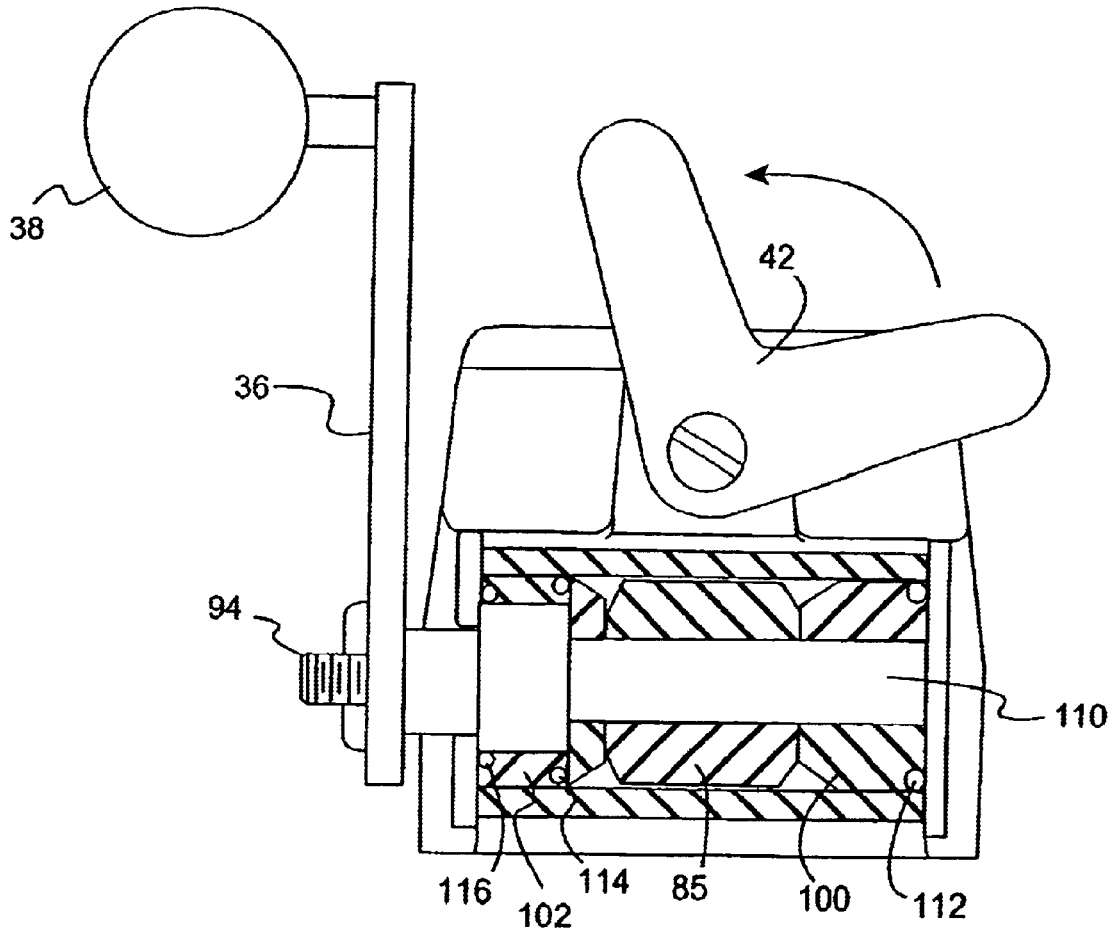
FIG. 6 is a cross sectional side view of the gearing assembly depicting left hand rotation.

FIG. 6 is a cross sectional side view of the gear driver assembly depicting the hand grip 38 on the left side of the assembly. The drive gear 85 having a drive gear shaft 110 is supported on either side of the drive gear 85 by the non-metallic bushings 100 and 102. The engagement lever 42 shown in non-engagement with support post 36 to allow rotation of the drive gear 85. Seals 112, 114 and 116 inhibit water intrusion around bearings 100 and 102. A thrust washer 118 is used for reducing friction and maintaining proper engagement between the drive gear and driven gear.

Figure 7:
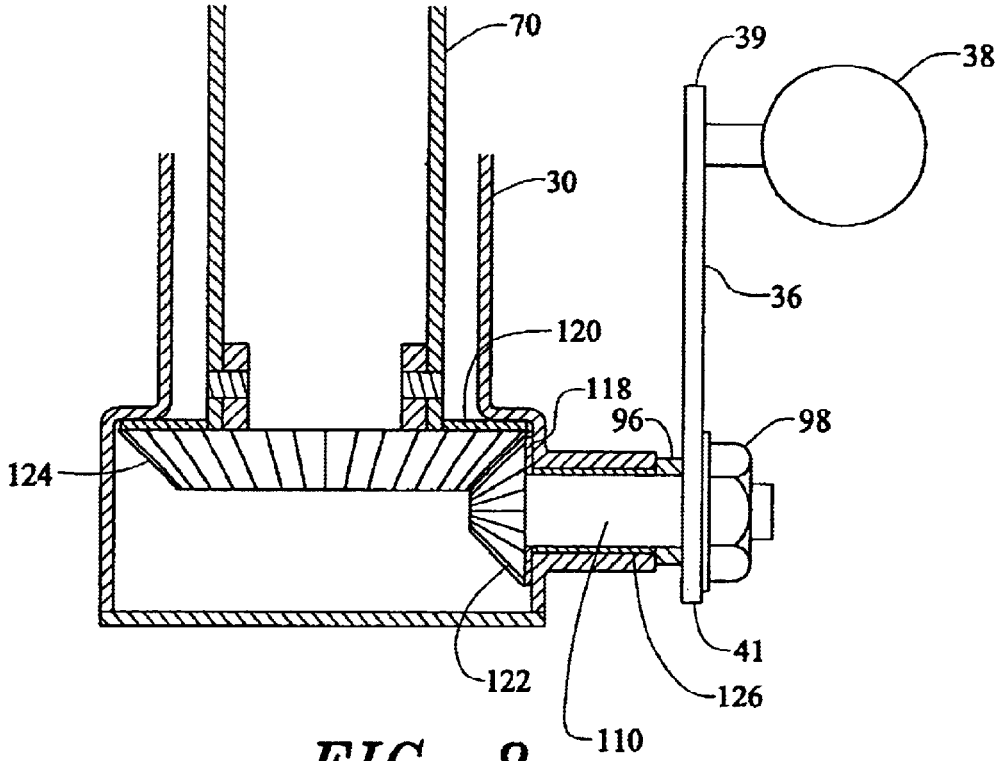
FIG. 7 is a cross sectional side view of an alternative embodiment of the present invention showing the gearing assembly.

FIG. 7 is a cross sectional side view of an alternative embodiment of the gear driver assembly depicting the hand grip 38 on the right side of the assembly and utilizing bevel gears. The bevel drive gear 122 having a drive gear shaft 110 being supported on one side of the drive gear 122 by the non-metallic DELRIN acetal bushing 126. Low maintenance non-metallic thrust washers 118 and 120 are used for reducing friction and maintaining proper engagement between the drive gear 122 and bevel driven gear 124. The support post 36 having slotted aperture 40 (not shown) is secured along a first end 39 to the hand grip 38 and along a second end 41 to the drive gear by any suitable means well known in the art. The fastening means illustrated herein as a threaded shaft, wherein the support post 36 is secured in place by washers 96 and a locking nut 98. Alternatively, a suitable flexible type coupling, not shown, but of a conventional type may be utilized to attach a hydraulic or electric motor to the drive gear shaft.

Figure 8:
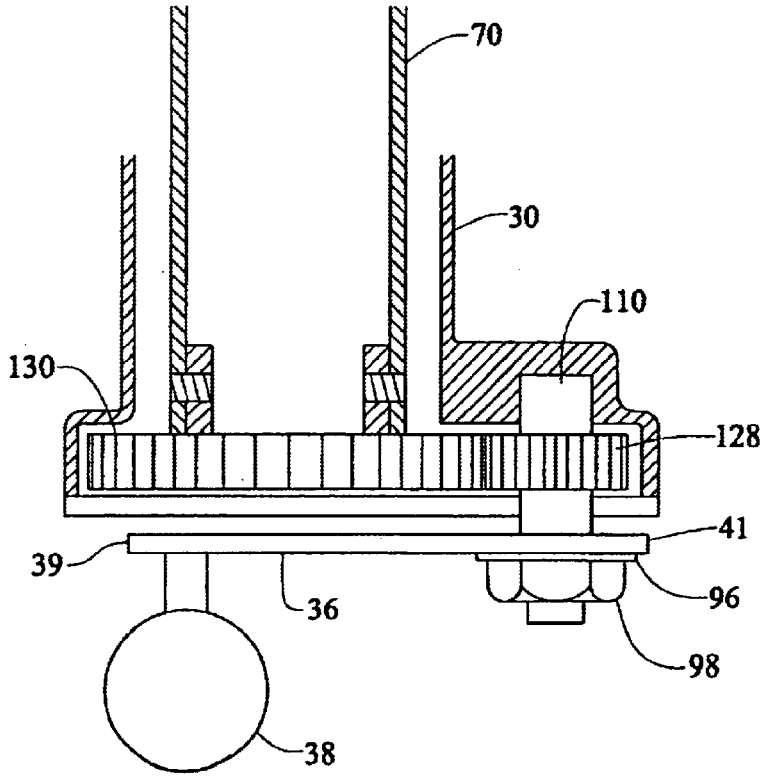
FIG. 8 is a cross sectional side view of an alternative embodiment of the present invention showing the gearing assembly.

FIG. 8 is a cross sectional side view of an alternative embodiment of the gear driver assembly depicting the hand grip 38 on the bottom side of the assembly and utilizing spur gears. The spur drive gear 128 having a drive gear shaft 110 being supported on either side of the drive gear 128 by the non-metallic DELRIN acetal bushings 100 and 102. The support post 36 having slotted aperture 40 (not shown) is secured along a first end 39 to the hand grip 38 and along a second end 41 to the drive gear by any suitable means well known in the art. The fastening means illustrated herein as a threaded shaft, wherein the support post 36 is secured in place by washers 96 and a locking nut 98. Alternatively, a suitable flexible type coupling, not shown, but of a conventional type may be utilized to attach a hydraulic or electric motor to the drive gear shaft.

Figure 9:
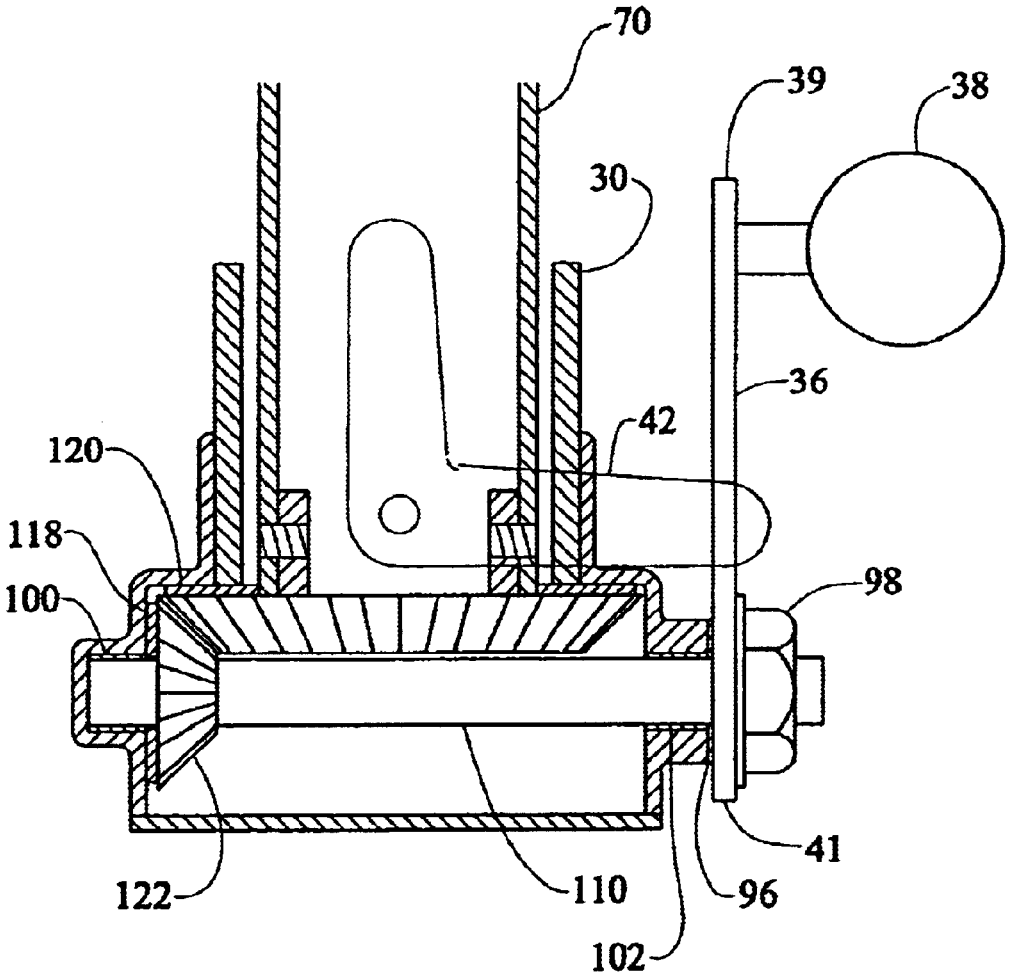
FIG. 9 is a cross sectional side view of an alternative embodiment of the present invention showing the gearing assembly.
Figure 10:
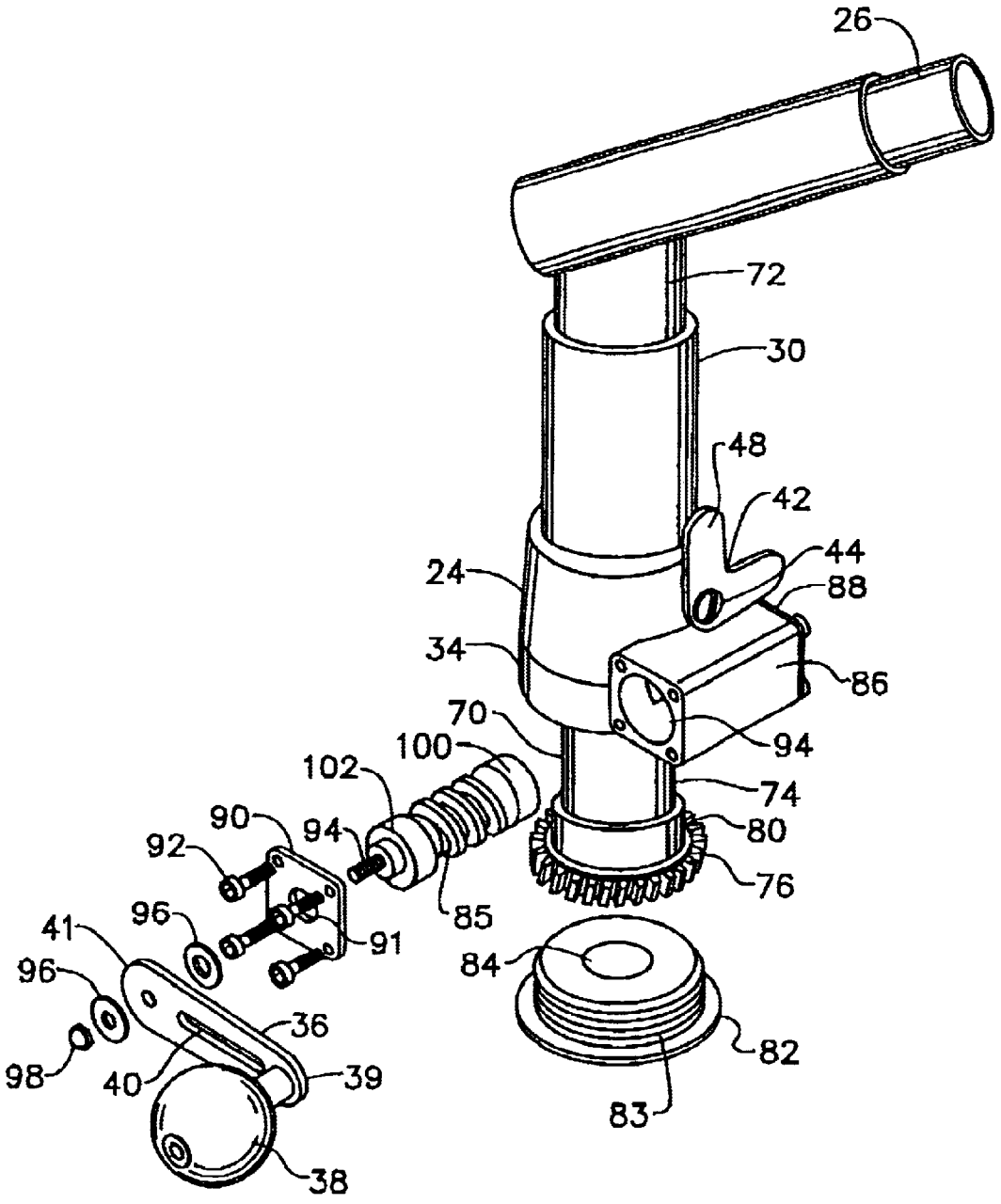
FIG. 10 is a partially exploded view of one embodiment of the instant invention illustrating the first and second tubular elements having longitudinal axis positioned in separate planes.

FIG. 9 is a cross sectional side view of an alternative embodiment of the gear driver assembly depicting the hand grip 38 on the right side of the assembly and utilizing bevel gears. The engagement level 42 shown in engagement with support post 36 to prevent rotation of the bevel drive gear 122. The bevel drive gear 122 having a drive gear shaft 110 being supported on either side of the drive gear 122 by the non-metallic bushings 100 and 102. Thrust washers 118 and 120 are used for reducing friction and maintaining proper engagement between the drive gear 122 and bevel driven gear 124. The support post 36 having slotted aperture 40 (not shown) is secured along a first end 39 to the hand grip 38 and along a second end 41 to the drive gear by any suitable means well known in the art. The fastening means illustrated herein as a threaded shaft, wherein the support post 36 is secured in place by washers 96 and a locking nut 98. Alternatively, a suitable flexible type coupling, not shown, but of a conventional type may be utilized to attach a hydraulic or electric motor to the drive gear shaft.

One skilled in the art will readily appreciate that the present invention is well adapted to carry out the objectives and obtain the ends and advantages mentioned, as well as those inherent therein. The embodiments described herein are presently representative of the preferred embodiments, are intended to be exemplary and are not intended as limitations on the scope. Changes therein and other uses will occur to those skilled in the art which are encompassed within the spirit of the invention and are defined by the scope of the appended claims. Although the invention has been described in connection with specific preferred embodiments, it should be understood that the invention as claimed should not be unduly limited to such specific embodiments. Indeed, various modifications of the described modes for carrying out the invention which are obvious to those skilled in the art are intended to be within the scope of the following claims.

I claim:

1. A gear-train driven outrigger device for use on a fishing vessel comprising:

a base member defined by a first tubular member rotatably journaled to a second tubular member;

an outrigger pole fixably secured to said first tubular member; and a gear-train driven positioning means constructed and arranged to provide infinite rotational adjustment of said first tubular member in relation to said second tubular member;

wherein said second tubular member of said base member includes a mounting bracket securable to said second tubular member of said base member, said mounting bracket allowing said base member to be secured to a fixed structure;

whereby said mounting bracket is fastened to a fixed structure wherein said gear-train driven positioning means is located beneath said fixed structure and said outrigger pole is located above said fixed structure;

whereby operation of said gear-train driven positioning means permits said outrigger pole secured to said first tubular member of said base member to be rotated from a stowage position to a trolling position and vice versa.

2. The gear-train driven outrigger device according to claim 1 wherein said gear-train driven positioning means includes a driven gear secured to said first tubular member and a drive gear secured to said second tubular member, wherein rotation of said drive gear provides rotation of said first tubular member and said outrigger pole secured thereto.

3. The gear-train driven outrigger device according to claim 1 including a lever lock pivotedly attached to said base member, said lever lock maintaining said outrigger pole at a desired angle upon engagement.

4. The gear-train driven outrigger device according to claim 1 wherein said gear-train driven positioning means is operated manually.

5. The gear-train driven outrigger device according to claim 1 wherein said gear-train driven positioning means is operated remotely.

6. The gear-train driven outrigger device according to claim 1 wherein said gear-train driven positioning means provides a gear reduction ratio greater than one to one.

7. The gear-train driven outrigger device according to claim 1 wherein said first tubular member has a first end and a second end with a longitudinal axis therebetween, said second tubular member has a top end and a bottom end with a second longitudinal axis therebetween, wherein said first and second longitudinal axis are positioned in the same plane.

8. The gear-train driven outrigger device according to claim 1 wherein at least a portion of said first tubular member is positioned within at least a portion of said second tubular member.

9. The gear-train driven outrigger device according to claim 1 including a bearing positioned between said first tubular member and second tubular member.

10. The gear-train driven outrigger device according to claim 9 wherein said bearing is non-metallic.

11. The gear-train driven outrigger device according to claim 1 wherein said first tubular member has a first end and a second end with a longitudinal axis therebetween, said second tubular member has a top end and a bottom end with a second longitudinal axis therebetween, wherein said first and second longitudinal axis are positioned in separate planes.

12. A gear-train driven outrigger device for use on a fishing vessel comprising:

a first tubular member having a first end and a second end;

a second tubular member having a top end and a bottom end, said first end of said first tubular member rotatably journaled to said bottom end of said second tubular member;

mounting means for fastening said second tubular member to a fixed structure;

an outrigger pole fixably secured to said second end of said first tubular member; and a gear-train driven positioning means mounted to said bottom end of said second tubular member and constructed and arranged to provide a constantly engaged infinite adjustment of said first tubular member;

wherein said first tubular member is rotatably journaled to said second tubular member to define a base member, said base member including a lever lock pivotedly attached thereto, said lever lock maintaining said outrigger pole at a desired angle upon engagement;

whereby operation of said gear-train driven positioning means permits said outrigger pole secured to said second end of said first tubular member to be moved from a stowage position to a trolling position and vice versa.

13. The gear-train driven outrigger device according to claim 12 whereby said mounting means is fastened to a T-top structure wherein said gear-train driven positioning means is located beneath said T-top structure and said outrigger pole is located above said T-top structure.

14. The gear-train driven outrigger device according to claim 12 wherein said gear-train driven positioning means includes a driven gear secured to said first tubular member and a drive gear secured to said second tubular member, wherein rotation of said drive gear provides rotation of said first tubular member and said outrigger pole secured thereto.

15. The gear-train driven outrigger device according to claim 12 wherein said gear-train driven positioning means is operated manually.

16. The gear-train driven outrigger device according to claim 12 wherein said gear-train driven positioning means is operated remotely.

17. The gear-train driven outrigger device according to claim 12 wherein said gear-train driven positioning means provides a gear reduction ratio greater than one to one.

18. The gear-train driven outrigger device according to claim 12 including a non-metallic bearing positioned between said first tubular member and second tubular member.

19. The gear-train driven outrigger device according to claim 18 wherein said bearing is acetal polymer.

20. A gear-train driven outrigger device for use on a fishing vessel comprising:

a first tubular member having a first end and a second end, said first end having a wormgear mounted thereto;

a second tubular member having a top end and a bottom end, said first end of said first tubular member rotatably secured to said bottom end of said second tubular member defining a base member, said base member including a lever lock pivotedly attached thereto, said lever lock maintaining said outrigger pole at a desired angle upon engagement thereof;

a bearing element operatively associated with said first and second tubular element;

mounting means for fastening said second tubular member to a fixed structure;

an outrigger pole fixably secured to said second end of said first tubular member; and a gear-train driver assembly including a worm juxtapositioned to said wormgear, said worm constructed and arranged to provide infinite adjustment of said outrigger pole upon rotation of said wormgear;

whereby operation of said gear-train driver assembly permits said outrigger pole secured to said second end of said first tubular member to be moved from a stowage position to a trolling position and vice versa.

21. The gear-train driven outrigger device according to claim 20 wherein said wormgear is rotated by use of a crank assembly secured one end of said worm.

22. The gear-train driven outrigger device according to claim 21 wherein said crank assembly is further defined as an elongated support post having a first end and a second end, said first end coupled to a said worm, said second end of said support post coupled to a hand grip.

23. The gear-train driven outrigger device according to claim 20 wherein said wormgear and said worm have conjugate surfaces.

24. The gear-train driven outrigger device according to claim 20 wherein said bearing element is non-metallic.

25. The gear-train driven outrigger device according to claim 24 wherein said bearing is acetal polymer.

26. A gear-train driven outrigger device for use on a fishing vessel comprising:

a base member defined by a first tubular member rotatably journaled to a second tubular member, said second tubular member securable to a fixed sttucture;

a gear-train driven positioning means constructed and arranged to provide infinite adjustment of said first tubular member in relation to said second tubular member, an outrigger pole having an attachment end sized to slidably insert into said first tubular member, wherein said gear-train driven positioning means is located beneath said fixed structure and said outrigger pole is located above said fixed structure;

a crank assembly secured to said gear-train driven positioning means, said gear-train driven positioning means is further defined as a wormgear coupled to said first tubular member and a worm having a first end and a second end each rotatably coupled to said second tubular member, paid wormgear and said worm arranged and sized to provide leverage reduction to said crank assembly;

whereby manual rotation of said crank assembly permits said first tubular member of said base member to be moved from a stowage position to a trolling position and vice versa.

27. The gear-train driven outrigger device according to claim 26 wherein said crank assembly includes a motor mechanically connected thereto, said motor having a switch for selective operation of said motor, wherein operation of said motor provides infinite automatic rotation of said first tubular member.

28. A gear-train driven outrigger device for use on a fishing vessel comprising:

a first tubular member having a first end and a second end, said first end having a wormgear mounted thereto;

a second tubular member having a top end and a bottom end, said first end of said first tubular member rotatably secured to said bottom end of said second tubular member, said second tubular member having a bearing fixed thereto for rotatable support of said first tubular member;

mounting means for fastening said second tubular member to a fixed structure;

an outrigger pole fixably secured to said second end of said first tubular member; and a gear-train driver assembly including a worm constructed and arranged to engage said wormgear, said worm having a first end and a second end with a conjugate surface therebetween;

a crank assembly securable to said worm, said crank assembly is defined as an elongated support post having an elongated structure with a first end and a second end, said first end coupled to said worm, said second end of said support post coupled to a hand grip; wherein said support includes an elongated aperature whereby rotation of said crank assembly while attached to said first end of said worm permits said outrigger pole to be moved from a stowage position to a trolling position and vice versa and, whereby rotation of said crank assembly while attached to said second end of said worm permits said outrigger pole to be moved from a stowage position to a trolling position and vice versa.

29. The gear-train driven outrigger device according to claim 28 including an engagement bracket secured to said second tubular member, said engagement bracket available for engaging said aperture of said support post for locking said crank assembly in a fixed position.

30. The gear-train driven outrigger device according to claim 29 wherein said engagement bracket is available for engaging said elongated aperture within said support post of said crank assembly when secured to said first end of said worm.

31. The gear-train driven outrigger device according to claim 29 wherein said engagement bracket is available for engaging said elongated aperture within said support post of said crank assembly when secured to said second end of said worm.

32. The gear-train driven outrigger device according to claim 29 wherein said engagement bracket is further defined as a L-shaped pivotedly attached bracket.

33. The gear-train driven outrigger device according to claim 28 wherein said crank assembly is secured to said second end of said worm.

34. The gear-train driven outrigger device according to claim 28 wherein said worm and said wormgear provide a gear reduction ration of about 30:1.

35. A gear-train driven outrigger device for use on a fishing vessel comprising:

a base member having a first tubular member rotatably journaled to a second tubular member, said base member securable to a fixed structure;

an outrigger pole fixably secured to said first tubular member; and a gear-train driven positioning means including a means for gear-train reduction, said gear-train driven positioning means constructed and arranged to provide infinite adjustment of said first tubular member in relation to said second tubular member, wherein said outrigger pole is positioned on a first side of said fixed structure and said gear-train driven positioning means is positioned on a second side of said fixed structure;

whereby operation of said gear-train driven positioning means permits said outrigger pole secured to said first tubular member of said base member to be moved from a stowage position to a trolling position and vice versa.

36. The gear-train driven outrigger device according to claim 35 wherein said means for gear-train reduction provides a gear reduction ratio greater than one to one.

37. The gear-train driven outrigger device according to claim 35 including a means for locking said gear-train driven positioning means in a fixed position.

* * * * *